United States Patent [19]

Bertolaja

[11] Patent Number: 4,601,078

[45] Date of Patent: Jul. 22, 1986

[54] MACHINE FOR ASSEMBLING BOX SOLE FOOTWEAR SEMIAUTOMATICALLY

[76] Inventor: Costantino Bertolaja, Via Fratelli Cagnoni, 3, 27029 - Vigevano (Pavia), Italy

[21] Appl. No.: 602,217

[22] Filed: Apr. 19, 1984

[30] Foreign Application Priority Data

May 2, 1983 [IT] Italy ..... 20892 A/83

[51] Int. Cl.[4] ..... A43D 25/07; A43D 25/00

[52] U.S. Cl. ..... 12/1 F; 12/133 R; 12/4.1; 12/142 RS; 36/14

[58] Field of Search ..... 12/142 T, 1 F, 1 W, 12/18.1, 4.1, 7, 52, 54.1, 123, 133 R, 141, 33, 17 R, 33.2, 33.4, 142 E, 142 P, 146 BR; 36/12, 14

[56] References Cited

U.S. PATENT DOCUMENTS

| | | | |
|---|---|---|---|
| 1,236,462 | 4/1918 | Payne | 12/33 |
| 1,735,986 | 11/1929 | Wray | 36/14 |
| 1,822,039 | 9/1931 | Kinney | 12/1 F |
| 1,825,276 | 9/1931 | L'Hollier | 12/133 R |
| 1,989,853 | 2/1935 | Finn | 36/14 |
| 2,362,059 | 11/1944 | Eppler, Jr. | 12/8.1 |
| 2,577,749 | 12/1951 | Griswold et al. | 12/133 R |
| 2,786,237 | 3/1957 | Keen et al. | 36/14 |
| 3,205,516 | 9/1965 | Wilisch | 12/8.1 |
| 4,266,314 | 5/1981 | Londner epouse Ours | 12/142 P |

*Primary Examiner*—Werner H. Schroeder
*Assistant Examiner*—Steven N. Meyers
*Attorney, Agent, or Firm*—Bucknam and Archer

[57] ABSTRACT

A machine is disclosed for assembling box sole footwear semiautomatically. The machine provides for carrying out a number of operations through a completely new method of footwear assembly, thus affording significant labor savings and low investment costs. Specifically, this machine for semiautomatically assembling footwear having so-called box soles comprises, in essence, a former provided, at the sides, with a plurality of perforations connected to a suction pump and mounted on an arm adapted for pivotal movement about a horizontal axis. The machine further comprises a rubber plate and members cooperating with it which are adapted to press the sole edge against the sides of the former.

2 Claims, 8 Drawing Figures

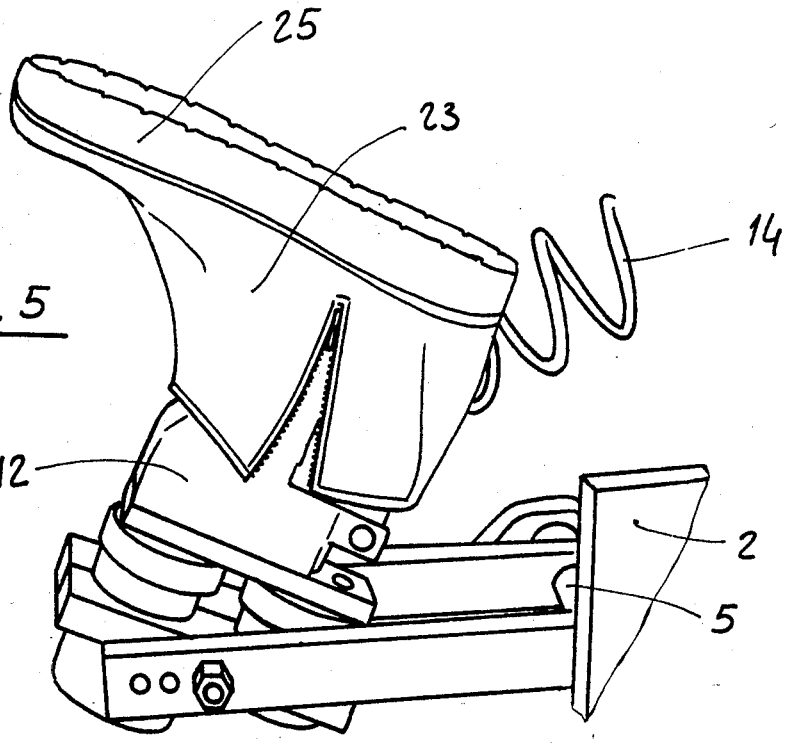
Fig. 5
Fig. 7
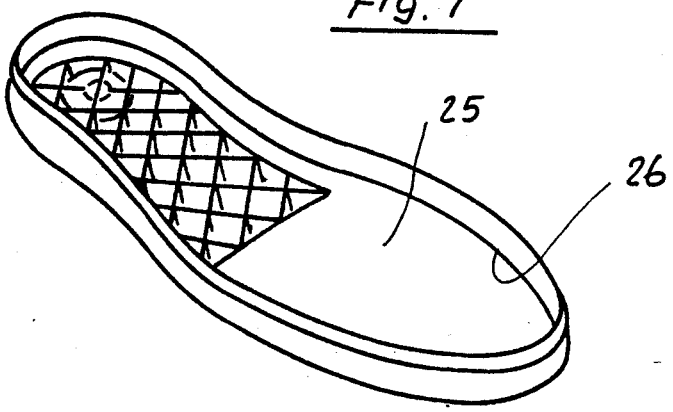

MACHINE FOR ASSEMBLING BOX SOLE FOOTWEAR SEMIAUTOMATICALLY

BACKGROUND OF THE INVENTION

This invention relates to a machine for assembling box sole footwear semiautomatically.

As is known, for the manufacture of sport shoes having raised edge soles (box soles), it is current practice to use a first machine attended by a first operator who nails the insole to the former, made either of a plastics or wood.

Thereafter, and with the assistance of a second machine, a second operator fits the uppers onto the former.

The former, so set up, is then passed to the carding station, where a third operator of a third machine will remove the surface portion from the hide, both across the sole and sides, as far high as these are to fit in the sole box.

This side carding operation is, on the other hand, quite difficult to carry out owing to the highly varying profile of the former, and although carried out on a machine is virtually performed by hand.

Consequently, the operator must possess a high degree of manual skill, and be careful not to remove too much of the hide, as this would result in the uppers breaking.

Subsequently to, the former is secured to the sole using a press and the assistance of another operator is required.

Prior to that operation, however, with the sole already coated with a cement layer, cement must be coated over the uppers, at the carded areas, such that the two parts may be joined together by pressing.

Finally, the nails used to secure the insole to the former must be removed, and the shoe released from the former.

In practice, therefore, with conventional equipment and methods, the manufacture of a footwear article involves the availability of several machines and at least four operators.

This reflects, of course, in increased investment and labor costs, which affect significantly the overall cost of the finished article.

SUMMARY OF THE INVENTION

It is an object of this invention to obviate such prior shortcomings by providing a machine for semiautomatically assembling footwear having soles of the box type, which can afford a drastic reduction in the personnel conventionally involved in the assembly operation.

A further object of this invention is to provide a machine for semiautomatically assembling box sole footwear, which enables the carding step, for the uppers edge intended for association with the sole, to be simplified and made easier.

It is another object of the invention to provide a machine for semiautomatically assembling footwear of the box sole type, which allows the creation of a processing center to which the sole, insole, and pretreated uppers are all conveyed, and from which finished footwear is delivered.

Still another object of this invention is to provide a machine for semiautomatically assembling box sole footwear, which has a simple construction and is reliable in operation.

These and other objects, such as will become apparent hereinafter, are achieved by a machine for assembling box sole footwear semiautomatically, according to the invention, characterized in that it comprises a former provided with plural perforations along the sides, the perforations being in communication with a suction pump, and mounted on an arm adapted for rotation about a horizontal axis, and in that it comprises a rubber plate extending on a horizontal plane and having members cooperating therewith, the members being effective to hold the sole edge pressed against the sides of said former.

BRIEF DESCRIPTION OF THE DRAWINGS

Further features and advantages of this machine for assembling box sole footwear semiautomatically will be more clearly understood from the following description of a preferred embodiment, as illustrated by way of example only in the accompanying drawings, where:

FIGS. 3, 4 and 5 illustrate the sequential steps of assembly of the uppers to the sole, on said former;

FIG. 7 shows the box sole.

DESCRIPTION OF THE PREFERRED EMBODIMENT

Figure 2:
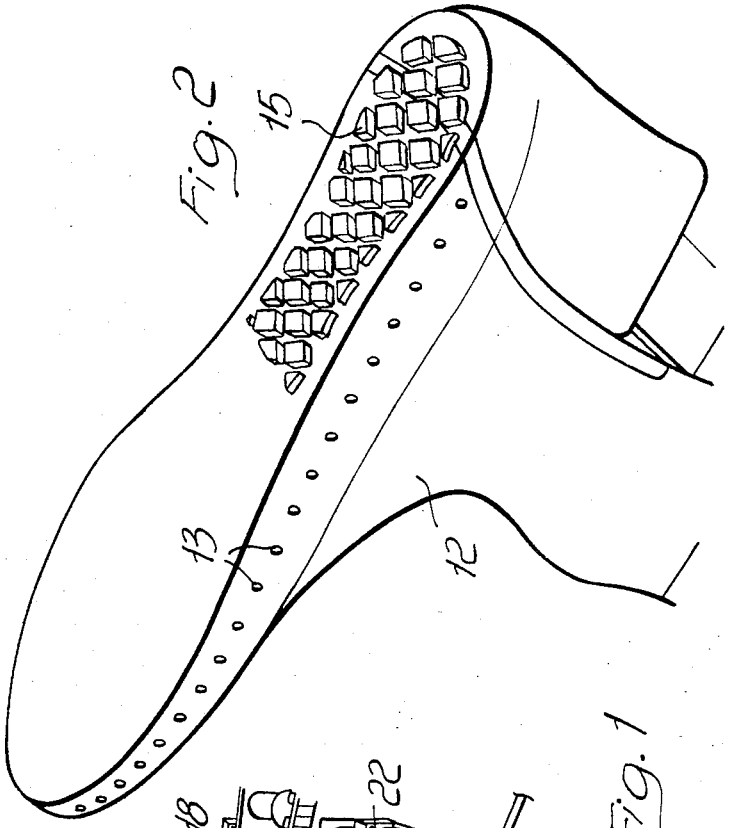
FIG. 2 is a detail view showing the shoe former.
Figure 1:
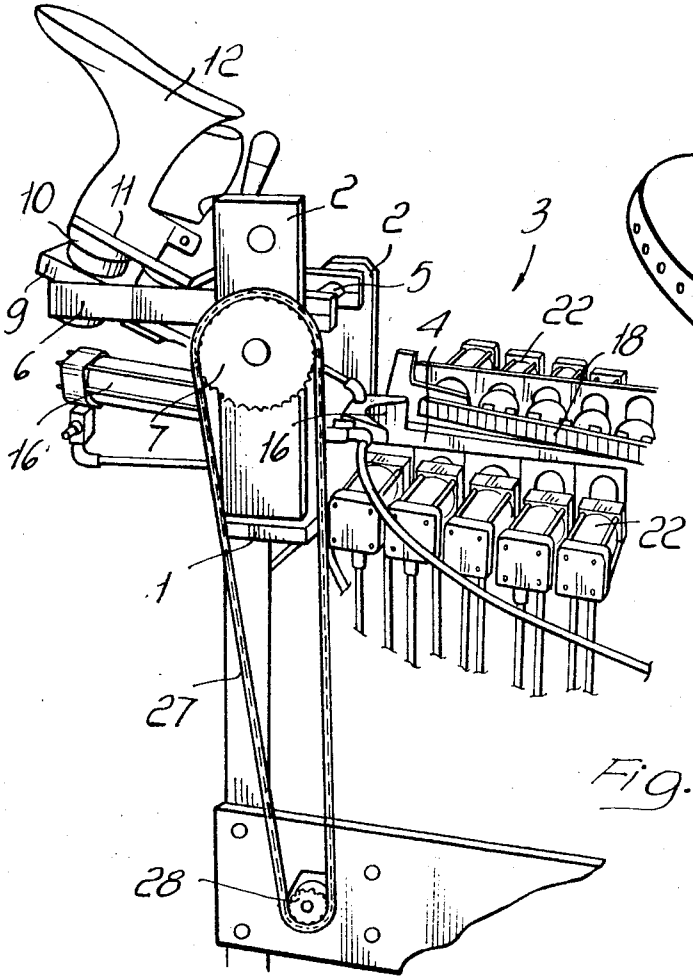
FIG. 1 is a fragmentary perspective view showing diagramatically the machine of this invention.

Making reference to the drawing views through the numerals appearing thereon, this machine for assembling box sole footwear semiautomatically comprises a bed 1 having a pair of uprights 2 and carrying a structure, generally indicated at 3, which includes a shaped rubber surface 4 tangentially whereto a plurality of vertical wall elements, as more fully described hereinafter, are suitably arranged to slide.

Between the uprights, there is journalled a first horizontal axle 5 having a pair of parallel arms 6 rigidly attached thereto and a sprocket wheel 7 keyed to one end.

The arm pair carry, with provision for orientation about a second horizontal axle 8, a plate 9 having at least two electromagnets 10 preferably of disc-like configuration.

The electromagnets are dimensioned to properly hold a base plate 11, obviously of a ferromagnetic material, of a shoe former 12.

The latter is provided, along its sides, with plural perforations 13 converging into an inner chamber which is connected, through a hose line 14, to one or more suction pumps.

Provided on the sole region of the former, at appropriate locations thereon, are projecting pegs 15.

The cited sliding elements on the rubber plate 4 include, arranged in an axial direction, two rubber jaws 16 and 17 which are driven by respective double-acting cylinders 16' and 17', and in a lengthwise direction, a plurality of vertical plates 18 which are articulated to a bar 19 and biased by a pair of springs 20, said bar being mounted in a support 21, in turn driven by a respective double-acting cylinder 22.

Figure 3:
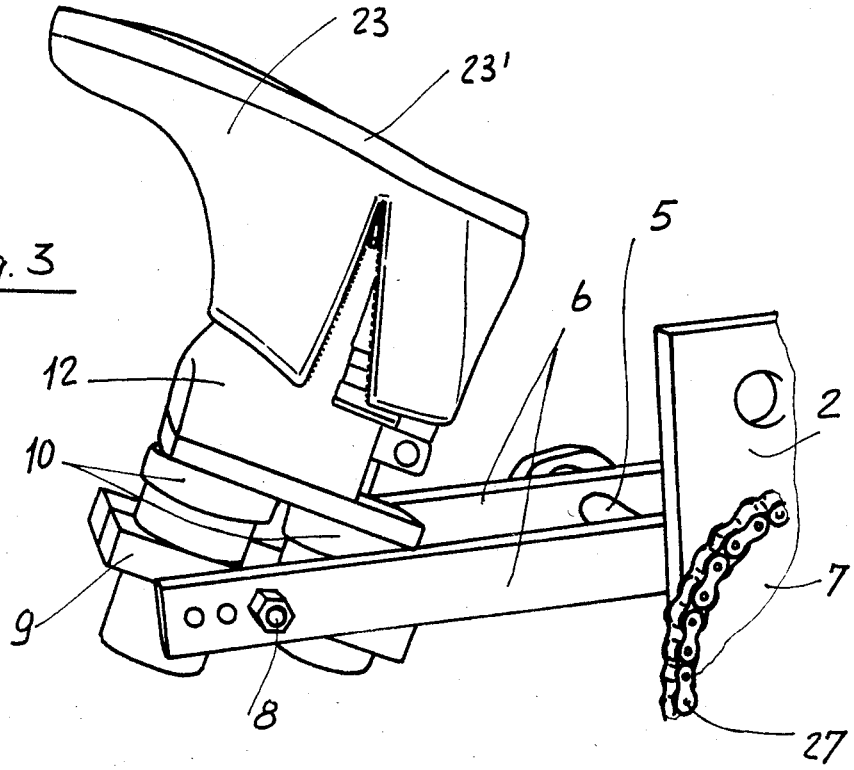

In actual practice, the operator would fit the uppers 23 on the former provided, and position it carefully by pressing it with his hands (FIG. 3).

The provision, in the former sides, of the perforations 13 connected to the suction pump is effective not only to hold the uppers closely against the former but also maintain it securely thereon, as required for subsequent processing.

It should be pointed out here that, owing to this expedient, the uppers does not require to be cut, as is conventional, in order to be turned over the sole region of the former, but should be rather cut to exactly end at the former sides, carefully along the profile.

The above method allows, in particular, prior carding of the edge 23' of the uppers, and its coating with a layer of cement through the use of automated operation machines, since the uppers is not yet fastened to the former.

Figure 4:
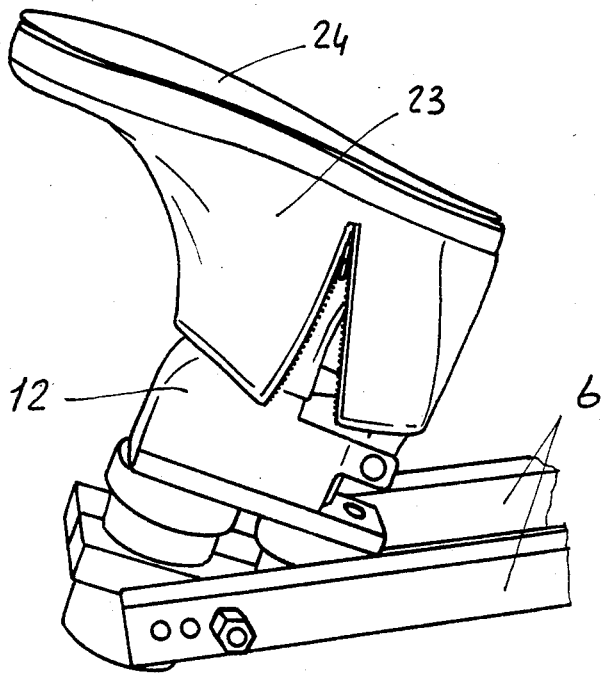

Thereafter, the operator would apply the insole 24 on the latter (FIG. 4), that insole operation of attachment and alignment to the former being facilitated by the presence of the projecting pegs 15, which align with respective holes provided in the insole itself.

On completion of the above operation, the operator would fit the box sole 25 to the insole, which box sole interlocks with a specially provided groove 26 on the interior side of the sole.

Figure 6:
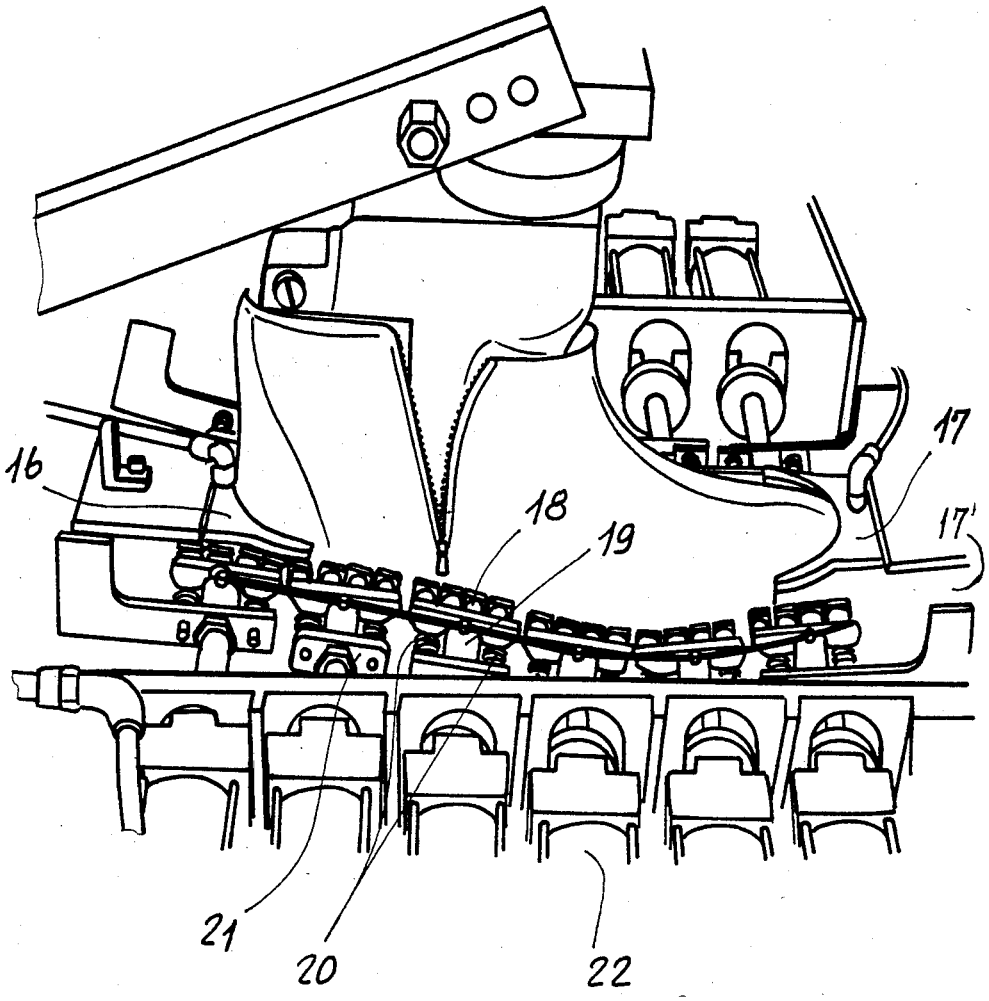
FIG. 6 shows how the edge of the box sole is pressed against the uppers.
Figure 8:
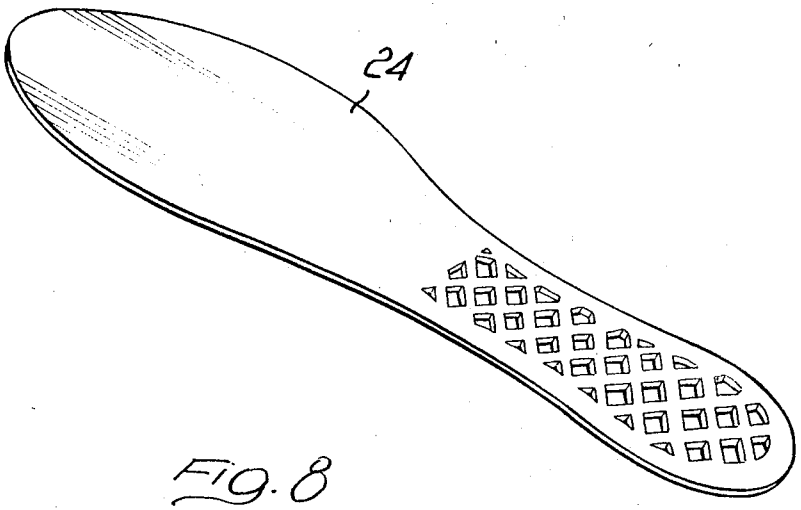

Then the operator would control the arm pair 6 to rotate, through the sprocket wheel 7, drive chain 27 trained around a sprocket pinion wheel 28 mounted on the saft of a gear motor or rotary cylinder, so as to position the former on the rubber surface 4, as shown in FIG. 6.

Thereafter, the two jaws 16 and 17, which are located at the toe and heel ends of the shoe, would clamp the sole at said ends while the plates 18 clamp them at the sides.

Upon completion of the pressing step, the arms 6 will return the former to its original position, thus enabling the operator to remove the shoe from the former and start a fresh processing cycle.

Advantageously, it is contemplated that two machines, as provided by this invention, be laid side by side on the bed 1 for alternate operation, thereby one operator can work on one during normal downtime (pressing time) of the other.

From the foregoing description and views of the accompanying drawings, it is possible to appreciate the high degree of functionality and practicality that characterizes the machine for assembling box sole footwear semiautomatically according to this invention.

Of course, this machine has been described and illustrated, by way of example and not of limitation, for the sole purpose of showing the practicability and general features of the invention, and it will be possible to introduce therein any changes and modifications which may occur to the skilled one and fall within the scope of the inventive idea set forth hereinabove.

I claim:

1. A machine for assembling box sole footwear semiautomatically, which comprises a former provided with plural perforations along the side thereof, the former having a base plate, a bed having a pair of uprights, a first horizontal axle being journalled between said uprights and carrying a pair of parallel arms rigidly attached thereto, a sprocket wheel keyed to one end thereof, a second horizontal axle journaled between said parallel arms and supporting a plate provided with at least two electromagnets said electromagnets holding the base plate of said former, a suction pump in communication with said perforations, a rubber plate extending on a horizontal plane and supported by said bed and having members cooperating therewith, said members holding the sole edge pressed against the sides of said former, said members comprising two rubber jaws arranged in an axial direction, driven by respective double-acting cylinders, a plurality of vertical plates arranged lengthwise articulated to a bar and being biased by a pair of springs, each of said bars being mounted in a support driven by a respective double-acting cylinder.

2. The machine according to claim 1 wherein the sole region of said former has at least two projecting pegs adapted to facilitate attachment and alignment of the insole, said insole being provided with matching holes.

* * * * *